US012559293B2

(12) United States Patent
Armenta

(10) Patent No.: US 12,559,293 B2
(45) Date of Patent: Feb. 24, 2026

(54) MULTI-SENSORY ENVIRONMENTALLY FRIENDLY PRODUCT PACKAGING ASSEMBLIES

(71) Applicant: Phoeben 2 LLC, Houston, TX (US)

(72) Inventor: Emily R. Armenta, Houston, TX (US)

(73) Assignee: Phoeben 2 LLC, Houston, TX (US)

( * ) Notice: Subject to any disclaimer, the term of this patent is extended or adjusted under 35 U.S.C. 154(b) by 190 days.

(21) Appl. No.: 18/389,179

(22) Filed: Nov. 13, 2023

(65) Prior Publication Data

US 2024/0158149 A1 May 16, 2024

Related U.S. Application Data

(60) Provisional application No. 63/424,816, filed on Nov. 11, 2022.

(51) Int. Cl.
*B65D 65/46* (2006.01)

(52) U.S. Cl.
CPC ..... *B65D 65/466* (2013.01); *B65D 2565/382* (2013.01); *Y10T 428/1303* (2015.01); *Y10T 428/1307* (2015.01)

(58) Field of Classification Search
CPC ..... B65D 65/466; B65D 2565/382; Y10T 428/1303; Y10T 428/1307
See application file for complete search history.

(56) References Cited

U.S. PATENT DOCUMENTS

| | | | |
|---|---|---|---|
| 9,090,372 | B2 | 7/2015 | Warner |
| 10,470,378 | B2 | 11/2019 | Shaffer et al. |
| 10,913,880 | B2 | 2/2021 | Parker et al. |
| 11,007,758 | B2 | 5/2021 | Nissenbaum et al. |
| 11,072,731 | B2 | 7/2021 | Parker et al. |
| 11,597,191 | B2 | 3/2023 | Bartolucci et al. |
| 2020/0010741 | A1 | 1/2020 | Kim et al. |

*Primary Examiner* — James C Yager
(74) *Attorney, Agent, or Firm* — Akerman LLP

(57) ABSTRACT

According to embodiments of the present disclosure a product packaging assembly may be fully biodegradable and/or compostable. The packaging assembly can include a biodegradable box, at least one piece of biodegradable tissue paper, and at least one biodegradable paper product. The biodegradable box may be assembled with a non-toxic, eco-friendly adhesive. At least one piece of tissue paper may be positioned within the interior cavity of the biodegradable box. The at least one paper product may be positioned within the interior cavity of the biodegradable box, and the paper product may include printing thereon using natural inks or natural earth pigment dyes.

20 Claims, 7 Drawing Sheets

1200

MULTI-SENSORY ENVIRONMENTALLY FRIENDLY PRODUCT PACKAGING ASSEMBLIES

CLAIM OF PRIORITY

The present application claims priority to U.S. Provisional Patent Application Ser. No. 63/424,816, filed on Nov. 11, 2022, the entire contents of which are incorporated herein by reference.

BACKGROUND OF INVENTION

Packaging assemblies often include multiple elements including boxes, bags, filler materials, information packets, labels and/or stickers, as well as shipping features such as tape, labels, and the like, some or all of which may not be sustainable and/or biodegradable and/or recyclable. The inclusion of non-sustainable, biodegradable and/or recyclable materials in product packaging may result in increasing the amount of trash in landfills and/or negatively impacting the environment. Currently, it is estimated that 91% of packaging waste is sent to landfills and/or into the environment. In 2019, the total volume of packaging waste generated was estimated at 79.3 million tons. Non-sustainable and/or non-recyclable and/or non-biodegradable and/or non-compostable materials used in packaging assemblies can also end up in the ocean which can have negative environmental impacts. It is desirable to reduce the amount of packaging waste sent to landfills and/or into the environment.

BRIEF SUMMARY

The terms "invention," "the invention," "this invention" and "the present invention" used in this patent are intended to refer broadly to all of the subject matter of this patent and the patent claims below. Statements containing these terms should be understood not to limit the subject matter described therein or to limit the meaning or scope of the patent claims below. Embodiments of the invention covered by this patent are defined below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In various embodiments according to aspects of the present disclosure, a product packaging assembly may include a biodegradable box including: a bottom panel; a plurality of side panels positioned adjacent to the bottom panel; and a top panel configured to be positioned adjacent the plurality of panels, wherein the bottom panel, the plurality of side panels and the top panel are configured to define an interior cavity; wherein the plurality of side panels and the bottom panel are coupled together using an adhesive, wherein the adhesive is biodegradable; at least one piece of tissue paper positioned within the cavity of the biodegradable box, wherein the tissue paper is biodegradable; and wherein at least one paper product is positioned within the interior cavity of the biodegradable box, wherein the at least one paper product is biodegradable, and wherein the paper product includes printing thereon including natural inks or natural earth pigment dyes.

BRIEF DESCRIPTION OF THE DRAWINGS

The disclosure will be readily understood by following detailed description in conjunction with the accompanying drawings, in which.

DETAILED DESCRIPTION

Figure 1:
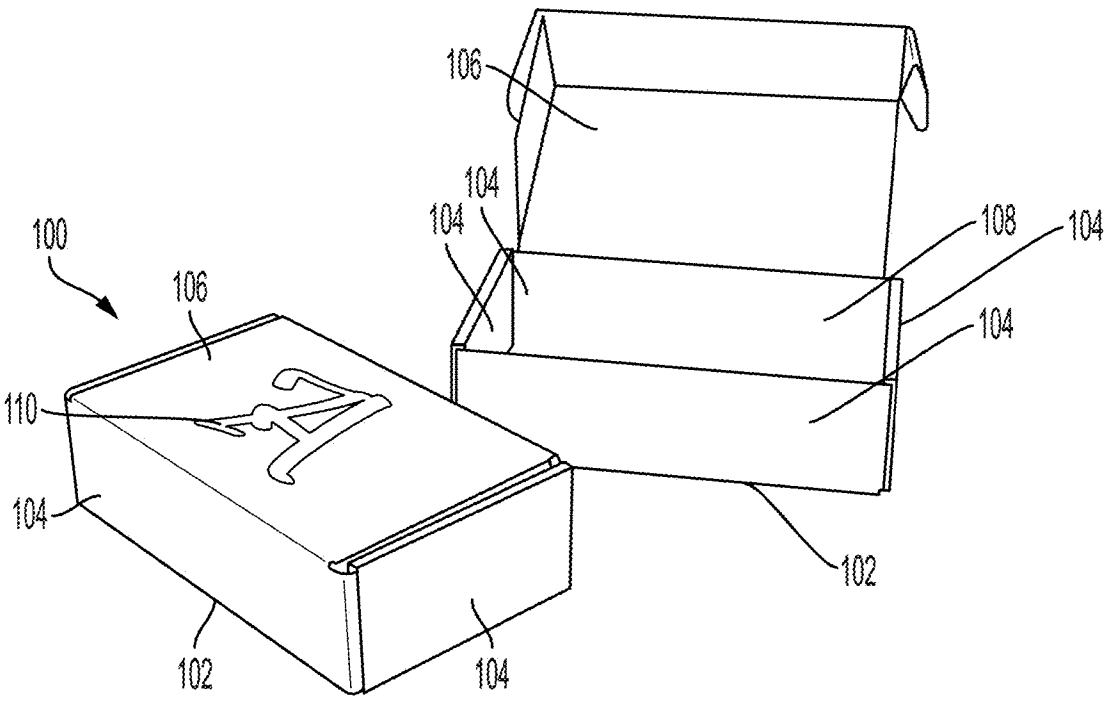
FIG. 1 is a perspective view of a first embodiment of a product packaging in accordance with the present disclosure.

The subject matter of embodiments of the present invention is described here with specificity to meet statutory requirements, but this description is not intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Each example is provided by way of illustration and/or explanation, and not as a limitation. For instance, features illustrated or described as part of one embodiment may be used on another embodiment to yield a further embodiment. Upon reading and comprehending the present disclosure, one of ordinary skill in the art will readily conceive many equivalents, extensions, and alternatives to the specific, disclosed luminaire types, all of which are within the scope of embodiments herein.

In the following description, positional terms like "above," "below," "vertical," "horizontal," "bottom," "top," and the like are sometimes used to aid in explaining and specifying features illustrated in the drawings as presented, that is, in the orientation in which labels of the drawings read normally.

Certain aspects and examples of the disclosure relate to packaging assemblies that include items, elements, or products that are biodegradable, recyclable, sustainable, compostable, and/or made of recycled materials. Biodegradable as used herein refers to materials, products, or items that may be disintegrated or decomposed by the action of microorganisms such as bacteria, fungi biological (with or without oxygen), or other natural means while being assimilated into the natural environment. Biodegradation is a process by which microorganisms break down complex compounds into simpler products. Biodegradable as used herein means that the product can get at least 90% biodegraded compared to a maximum disintegration of a reference substance in no more than nine (9) months. In some additional embodiments, biodegradable may additionally have maximum disintegration time in a range of 4 months to 24 months. Biodegradable materials may include degradation times of about 4 months, 5 months, 6 months, 7 months, 8 months, 9 months, 10 months, 11 months, 12 months, 13 months, 14 months, 15 months, 16 months, 17 months, 18 months, 19 months, 20 months, 21 months, 22 months, 23 months, 24 months, or any time frame in between the described disintegration times.

Compostable as used herein refers to an item or product that may be disintegrated or decomposed by the action of microorganisms such as bacteria or fungi biological into organic matter without ecological harm during the process. The compost process may be achieved via either residential composting or commercial composting. While all compostable elements are also biodegradable, not all biodegradable products are compostable as compostable material may leave behind additional organic matter. Additionally, compostable material may break down faster than biodegradable materials. Compostable material may disintegrate in a range of time between 15 days and 2 years in residential and/or commercial composting facilities. In some embodiments, the term composting may mean that a material that may include disintegration times of about 15 days, 30 days, 45 days, 90 days, 180 days, 365 days, or any time frame in between the described disintegration times.

Non-limiting examples of biodegradable and/or compostable materials may include recycled paperboard, recycled paper, recycled rigid board, plant-based materials (e.g. without limitation bamboo, cork, hemp, jute, wood, areca palm leaf, avocado bio-plastic, bagasse, wheat straw, cactus leather, pineapple leather, mycelium, or Mirum and Clarus from Natural Fiber Welding), tea bags, reused newspapers, grapeseed, apple peel leather, reused cardboard, mushroom leather, leaf leather, grain-based leather, recycled fibers, sustainably sourced fibers, and/or other natural materials.

Furthermore, fibers may be used as an alternative to traditional wood pulp paper for providing tree-free paper which may be more sustainable than traditional pulp paper. Such fibers may include agricultural residues, sugarcane bagasse, husks and straw, fiber crops, and wild plants such as bamboo, hemp, jute, flax and kenaf. In some aspects such tree-free paper may produce fewer greenhouse gases in comparison to paper that may be sourced from substantially virgin forest fibers. For example, Bamboo can grow fast and be more efficient at sequestering carbon dioxide. In addition, paper material comprising bamboo fibers can be recycled along with other eco-friendly fibers. In other aspects, paper products can comprise tree-free fibers such as sugarcane husks and bamboo grass, which are environmentally sustainable resourced. For example, sugar husks are a waste product from the production of sugar and are often just burned, by using them for paper products an otherwise unused material can be reused. Paper products made from hemp can have a lower lignin content than wood. Hemp can contain 5% to 24% lignin as compared to wood that has 20% to 35%. This is advantageous as lignin must be removed from the pulp before it can be processed as paper. In some aspects, recycled paper may be used for one or more elements of the packaging assembly. Recycled paper is eco-friendly as it uses less energy, water, and produces lower carbon emissions than the manufacturing of non-recycled paper and at the same time reduces the amount of waste to landfills, as paper can be recycled 4-7 times before the paper fibers break down. According to aspects of the present disclosure, one or more elements of the packaging assembly may include eco-friendly alternatives to traditional paper or mill made paper, with a zero-carbon footprint and a healthier overall impact without chemical treatment.

Product packaging assemblies according to the present disclosure may include a combination of components described herein as to provide a fully biodegradable, compostable, and/or recyclable packaging assembly. In further detail, by way of using packaging products, filler materials, support materials, paper products, adhesives, shipping packages, pouches, bags, or other product packaging elements that are specifically biodegradable and/or compostable, along with natural inks or natural earth pigment dyes for printing, a fully biodegradable and/or compostable product packaging assembly may be achieved. Generally, in view of the foregoing, an assembly may include any combination of components described herein and still maintain an overall biodegradable and/or compostable profile. By making the packaging assembly (all the elements) biodegradable and/or compostable the entirety of the packaging assembly may be biodegraded and/or composted to reduce waste materials sent to landfills. Where one or more elements of a product packaging is not biodegradable and/or compostable it may reduce the likelihood of the product being biodegraded and/or composted (and/or recycled) due to the need to separate out elements of the packaging for different processing (e.g. biodegrading, composting, recycling, disposal in a land fill). In addition, the use of materials that may be reused, for example tea bags, seed paper, etc. provide for a packaging assembly that has use beyond its initial packaging and provides for a multi-sensory experience. Furthermore, the packaging assembly described herein may be multi-sensory for a user. For example, the packaging products, elements, and components described below may engage each of the senses of a user (e.g., taste, hearing, touch, smell, and sight).

Referring to FIG. 1, which depicts a perspective view of a biodegradable and/or compostable product packaging 100. The product packaging 100 may in some embodiments include only materials that are biodegradable and/or compostable (as described in further detail below), including adhesives used to form the product packaging 100 and natural inks or natural earth pigment dyes for printing on the packaging 100. The product packaging 100 may generally include a bottom panel 102, a plurality of side panels 104 positioned adjacent to and extending upwards from the bottom panel 102, and a top panel 106 positioned opposite the bottom panel 102. The bottom panel 102, the plurality of side panels 104, and the top panel 106 may be configured to define an interior cavity 108. In some embodiments, the product packaging 100 may be selectively transitioned between an open configuration and a closed configuration. In the open configuration, the interior cavity 108 may be exposed such that a user may interact with the interior of the product packaging 100. The product packaging 100 may be formed using biodegradable and/or compostable adhesives that may also be environmentally safe/eco-friendly. For example, a starch-based adhesive or, alternatively, or in addition to, a water-activated or water-based eco-friendly adhesive may be used. In some embodiments, and discussed in further detail below, the adhesive may be replaced by or supplemented with biodegradable and/or compostable tape.

In some embodiments, the product packaging 100 be constructed or manufactured using at least partially recycled materials, recyclable materials, renewable materials, organic materials, post-consumer waste material, and/or biodegradable materials. For example, the product packaging 100 may be constructed using untreated recycled rigid cardboard, recycled paperboard, recycled paper, recycled rigid board, plant based materials (e.g., bamboo, cork, hemp, jute, wood, areca, palm leaf, avocado bio-plastic, bagasse, wheat straw, cactus leather, pineapple leather, mycelium, or Minim and Clarus from Natural Fiber Welding), tea bags, reused newspapers, grapeseed, apple peel leather, reused cardboard, mushroom leather, leaf leather, grain-based leather, recycled fibers, sustainably sourced fibers, and/or other natural materials. In some embodiments, fibers for providing tree-free paper such as agricultural residues, sugarcane bagasse, husks and straw, fiber crops, bamboo, hemp, jute, flax, or kenaf may be used to manufacture the box. The biodegradable, compostable, and/or recyclable materials described herein are merely exemplary and are not intended to be limiting. For example, other biodegradable, compostable, and/or recyclable materials not described above may be used to partially or completely construct the product packaging 100. Additionally, the materials used to construct the product packaging 100 may be chosen based on their texture, smell, and/or aesthetic qualities such that a user's sense of touch and sight may be engaged.

Furthermore, the product packaging 100 may be printed with natural inks or natural earth pigment dyes that do not harm the environment during biodegradation/composting. The printing 110 thereon may include various information such as branding, product information, directions, etc. Furthermore, the product packaging 100 may be embossed such that information may be positioned on the product packaging 100 without the use of additional chemicals or materials.

Figure 3:
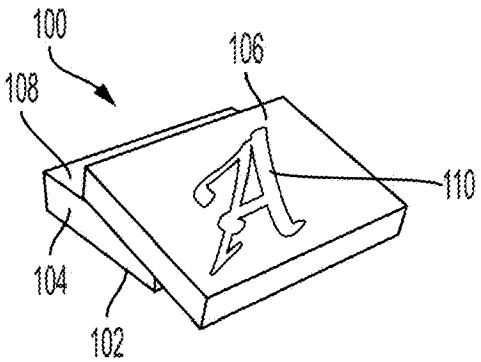
FIG. 3 is a perspective view of a third embodiment of a product packaging in accordance with the present disclosure.

The product packaging 100 as shown in FIG. 1 is merely exemplary and various shapes and sizes of product packaging's having an internal cavity for receiving a product are envisioned within the scope of this disclosure, so long as the packaging is biodegradable and/or compostable. For example, FIG. 2, which depicts a perspective view of an alternative embodiment of the product packaging 100, includes a top panel 106 which is foldable relative to the plurality of side panels 104 and may at least partially cover the side panels 104 when in the closed configuration. In yet another embodiment and in reference to FIG. 3, the top panel 106 may take the form of a cover such that the top panel 106 may not be secured to the bottom panel 102 and the plurality of side panels 104. The product packaging 100 depicted in FIG. 2 may also be formed entirely of biodegradable and/or compostable materials including the material that forms the panels, any adhesives utilized, and natural inks or natural earth pigment dyes for printing 110 used in the packaging.

Figure 4:
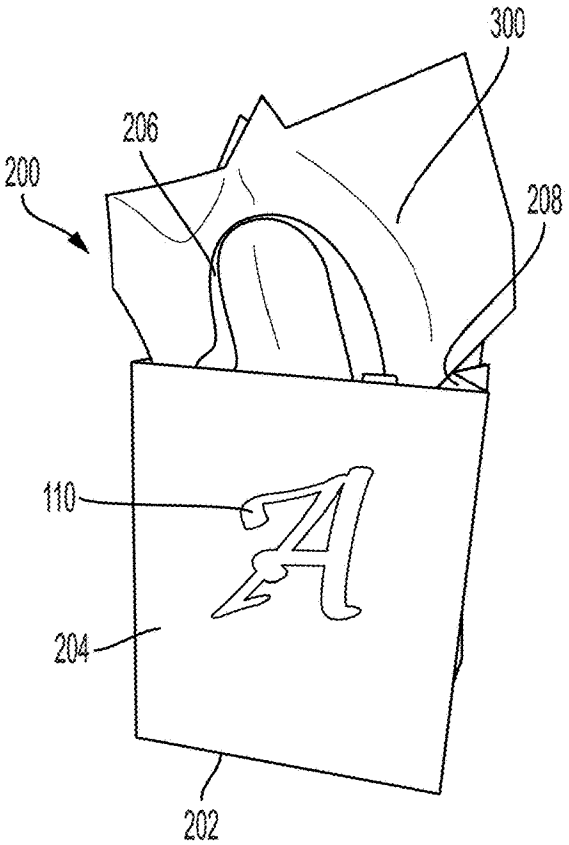
FIG. 4 is a perspective view a product packaging in accordance with the present disclosure.

Referring now to FIG. 4, which depicts a perspective view of a biodegradable, compostable, and/or recyclable product packaging 200. The product packaging 200 may generally be a bag-like packaging that may include a base 202 and at least one side 204 which extends generally upwards from the base 202. Similarly to the product packaging 100 described above, the base 202 and the at least one side 204 define an interior cavity 208 which may be configured to hold or contain a product. In some embodiments, the base 202 and the at least one side 204 are formed from a unitary material, however, this is not necessary and, in some embodiments, the base 202 and the at least one side 204 are manufactured separately before being coupled together using a fastening means such as a biodegradable and/or compostable adhesive that may also be environmentally safe adhesive. For example, a starch-based adhesive which is eco-friendly, recyclable, and biodegradable may be used. In some embodiments, the product packaging 200 may additionally include at least one handle 206 configured to provide a user with a holding point and which may be made from biodegradable and/or compostable materials such as natural fibers, including but not limited to cloth, twine, or paper, or tree-free fibers as described above. For example, such fibers may include agricultural residues, sugarcane bagasse, husks and straw, fiber crops, and wild plants such as bamboo, hemp, jute, flax and kenaf.

The product packaging 200 may be constructed or manufactured using at least partially recycled materials, recyclable materials, renewable materials, organic materials, and/or post-consumer waste material. For example, the product packaging 100 may be constructed using untreated recycled rigid cardboard, recycled paperboard, recycled paper, recycled rigid board, plant based materials (e.g., bamboo, cork, hemp, jute, wood, *areca*, palm leaf, avocado bio-plastic, bagasse, wheat straw, cactus leather, pineapple leather, mycelium, or Mirum and Clarus from Natural Fiber Welding), tea bags, reused newspapers, grapeseed, apple peel leather, reused cardboard, mushroom leather, leaf leather, grain-based leather, recycled fibers, sustainably sourced fibers, and/or other natural materials. In some embodiments, fibers for providing tree-free paper such as agricultural residues, sugarcane bagasse, husks and straw, fiber crops, bamboo, hemp, jute, flax, or kenaf may be used to manufacture the box. The biodegradable, compostable, and/or recyclable materials described herein are merely exemplary and are not intended to be limiting. For example, other biodegradable, compostable, or recyclable materials not described above may be used to partially or completely construct the product packaging 200. As noted with regards to the product packaging 100, the materials used to construct the product packaging 200 may be chosen based on their texture, smell, and/or aesthetic qualities such that a user's sense of touch and sight may be engaged.

Furthermore, the any component of the product packaging 200 may be printed with natural inks or natural earth pigment dyes that do not harm the environment during biodegradation/composting. The printing 110 thereon may include various information such as branding, product information, directions, etc. Furthermore, the product packaging 200 may be embossed such that information may be positioned on the product packaging 200 without the use of additional chemicals or materials.

It may be additionally appreciated that the product packaging 100, 200 may be combined with any of the foregoing components described herein to form a packaging assembly that is biodegradable and/or compostable in its entirety without separation of elements that may otherwise not be biodegradable and/compostable.

Still in reference to FIG. 4, support materials may be used within the product packaging 200 to cover a product therein or provide a visual decoration for gifting of the product within the packaging 200. The support material may include, but is not limited to, tissue paper 300. The tissue paper 300 may be wrapped around an object or product to provide protection and/or provide aesthetic benefits to the interior cavity 108, 208 of the product packaging 100, 200. In use, singular piece of tissue paper 300 or multiple pieces of tissue paper 300 may be used simultaneously. For example, a first piece of tissue paper 300 may be used to wrap the product, while a second piece of tissue paper 300 may be positioned around the product and positioned as to extend outwards from the interior cavity 108, 208 as to provide an enticing and aesthetically pleasing effect while providing protection to the product. The tissue paper 300 may be constructed from recycled paper, compostable paper, and/or biodegradable paper. In some embodiments, the tissue paper 300 may manufactured using FSC-certified recycled or recyclable paper. In some aspects, the tissue paper 300 may include a non-tree paper material so as to reduce environmental impacts. Furthermore, it is envisioned that tissue paper may be fully compostable within 180 days in a residential composting facility or within 90 days in a commercial composting facility. The materials used to construct the tissue paper 300 may be chosen based on their texture, smell, and/or aesthetic qualities such that a user's sense of touch, hearing, and sight may be engaged by the tissue paper 300. Additionally, the tissue paper 300 may be printed on with natural inks or natural earth pigment dyes. The printing 110 thereon may include various information such as branding, product information, directions, etc. Furthermore, the tissue paper 300 may be embossed such that information may be placed on the paper 300 without the use of additional chemicals or materials. It may be additionally appreciated that the tissue paper 300 may be combined with any of the foregoing components described or previous components described herein to form a packaging assembly that is biodegradable and/or compostable in its entirety without separation of elements that may otherwise not be biodegradable and/compostable.

Figure 7:
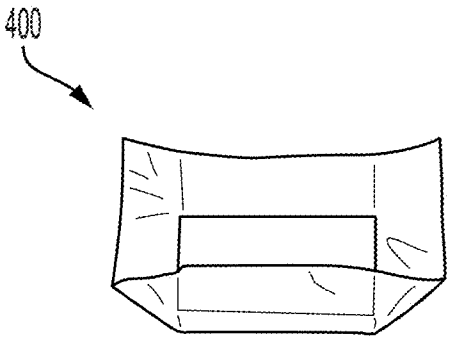
FIG. 7 is a perspective view of a third embodiment of a paper product in accordance with the present disclosure.
Figure 6:
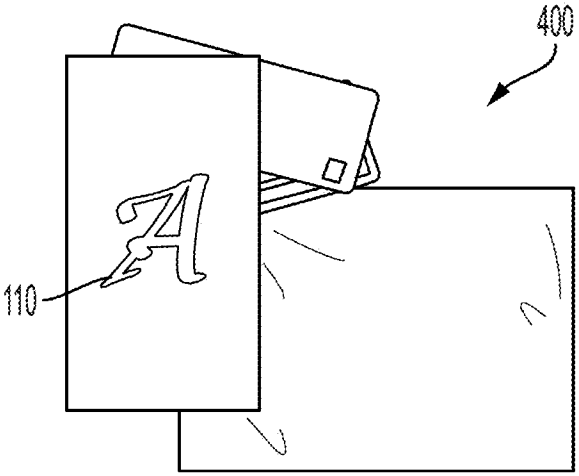
FIG. 6 is a perspective view of a second embodiment of a paper product in accordance with the present disclosure.
Figure 5:
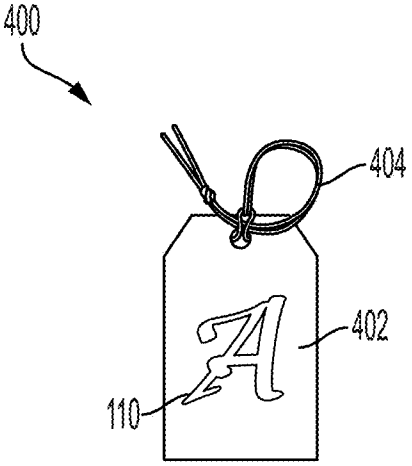
FIG. 5 is a perspective view of a first embodiment of a paper product in accordance with the present disclosure.

Referring now to FIGS. 5-7, biodegradable, recyclable, and/or compostable paper products 400 may be positioned within, alongside the product packaging 100, 200, or coupled/connected to a product within the product packaging 100, 200. For example, cards, information packets stationary, branded materials, receipts, labels, or other paper products may be used to provide a user or customer with information related to a product, the purchase, instructions for use, the brand, and/or any other information.

Referring now to FIG. 5, the paper product 400 may include a base 402 be manufactured using biodegradable, recyclable, and/or compostable materials and further may be optionally attached to the product or product packaging via a connector 404 that is also biodegradable, recyclable, and/or compostable. In some embodiments, the paper product 400 may be constructed using tree-free paper using alternative fibers. In some embodiments, each paper product used within a product packaging assembly may be constructed using recycled material (including but not limited to 100% recycled), recyclable material, renewable material, organic material (e.g. organic fibers), post-consumer waste material (e.g. post-consumer pulp), and/or other biodegradable material. The material provided herein are merely exemplary and are not intended to be limiting, other biodegradable, recyclable, and/or compostable materials may be used to construct the paper products and are envisioned within the scope of this disclosure.

In reference to FIG. 6, the paper product(s) 400 may in some embodiments, be constructed using seed paper. In some embodiments, the seed paper may include a biodegradable and/or compostable medium in which a plurality of seeds may be embedded. After use, the seed paper may be planted in the ground or the soil such that the biodegradable and/or compostable medium may break down, such that the seeds may grow a plant. In some embodiments, the seeds may include flower seeds (e.g. wild-flower seeds), herb seeds, plants, and/or vegetable seeds, that may be planted in the ground where it may grow into a plant. In other embodiments, different types of seeds may be included in the seed paper (non-limiting example shown below). Further, it is envisioned that non-GMO seeds may be used. The biodegradable and/or compostable medium in which the seeds are embedded may include at least partially recyclable and/or biodegradable materials and, in some embodiments, may require no chemical during production. For example, the medium may include recycled material (including but not limited to 100% recycled), recyclable material, renewable material, organic material (e.g. organic fibers), post-consumer waste material (e.g. post-consumer pulp), and/or biodegradable material. The seed paper may include materials such as hemp, coffee chaff, denim, coffee beans, or other natural elements. The hemp may be sourced from hemp garment scraps. For example, the seed paper may include hemp paper made with FSC certified pulp and blended with hemp fiber pump. The hemp paper may be 100% biobased with no petroleum content. In some aspects, the hemp paper may be blended with post-consumer pulp in 25% hemp 75% PCW ratio. By using post-consumer pulp, no virgin tree fiber is used and there is less of an environmental impact by not contributing to deforestation. In reference to FIG. 7, the paper products 400 may additionally be constructed of hemp paper as described above, without the addition of the embedded seeds, such that the paper products 400 still retain their biodegradable and/or compostable attributes. It may be additionally appreciated that the paper products 400 described herein may be combined with any of the foregoing components described or previous components described herein to form a packaging assembly that is biodegradable and/or compostable in its entirety without separation of elements that may otherwise not be biodegradable and/compostable. Additionally, paper products 400 manufactured using the seed paper may invoke the senses of a user, for example, the scent and taste of plants grown by the paper products 400 may be appreciated by a user. Alternatively, if seed paper is not used to construct the paper products 400, the materials for construction may be chosen based on their texture, smell, and/or aesthetic qualities such that a user's sense of touch and sight may be engaged by the tissue paper 300.

Each paper product 400 may be printed on with natural inks or natural earth pigment dyes such that any ink or dyes do not harm the environment upon biodegradation and/or composting of the paper product 400. The printing 110 thereon may include various information such as branding, product information, directions, etc. Furthermore, the printing 110 on each paper product 400 may take the form of embossing such that information may be placed on each paper product 400 without the use of additional chemicals or materials.

Figure 9:
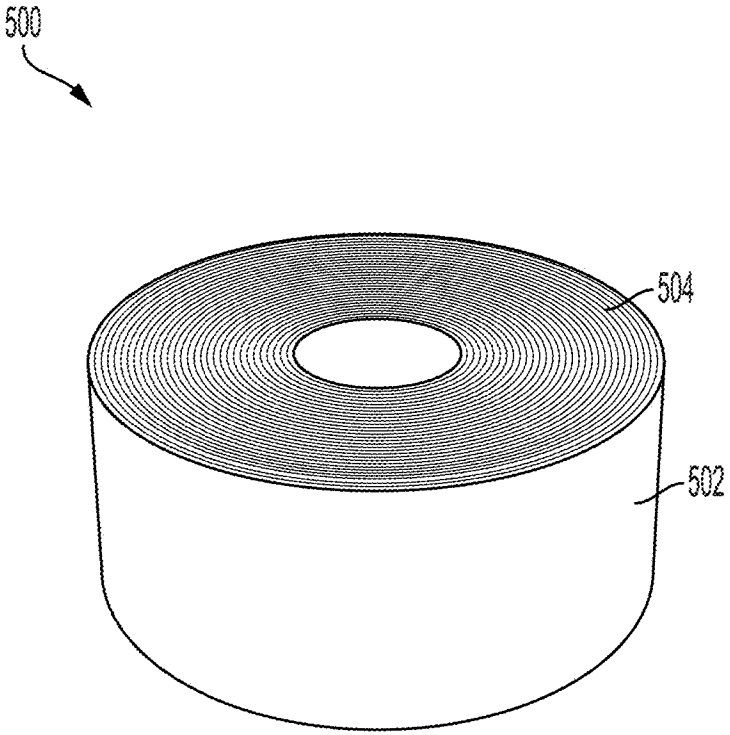
FIG. 9 is a perspective view of a second embodiment of an adhesive paper product in accordance with the present disclosure.
Figure 8:
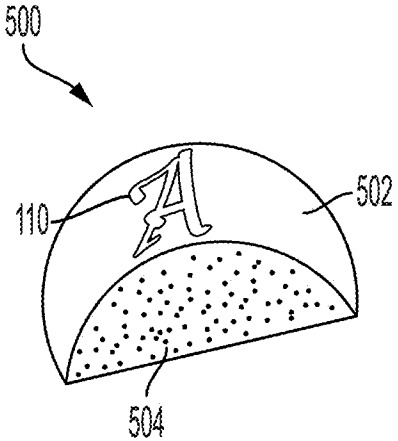
FIG. 8 is a perspective view of a first embodiment of an adhesive paper product in accordance with the present disclosure.

Now in reference to FIGS. 8 and 9, which depict adhesive paper products 500, such as stickers or labels as depicted in FIG. 8, or tape as depicted in FIG. 9. Such adhesive paper products 500 may be included within or accompany the product packaging 100 or the product packaging 200. The adhesive paper product 500 may include a base 502 constructed from recycled material (including but not limited to 100% recycled), recyclable material, renewable material, organic material (e.g. organic fibers), post-consumer waste material (e.g. post-consumer pulp), seed paper as described above and/or biodegradable material. A biodegradable and/or environmentally safe adhesive (e.g., a starch-based adhesive) 504 may be applied to at least a portion of the base such that the adhesive paper product 500 may adhere or be secured to an object. For example, a sticker may be secured to at least one piece of tissue paper 300 to contain the tissue paper 300 within the interior cavity 108, 208 and/or provide aesthetic benefits. Similarly, a biodegradable and/or compostable label may include shipping information, product information, or other information printed thereon and may be secured to any component of the product packaging assembly to provide a user with information. Finally, biodegradable and/or compostable tape may be used to secure components together, for example, in some embodiments the product packaging 100, 200 may be constructed or held together using tape.

As described with reference to the paper products 400 above, each adhesive paper product 500 may be printed on with natural inks or natural earth pigment dyes such that any ink or dyes do not harm the environment upon biodegradation and/or composting of the paper products 400. The printing 110 thereon may include various information such as branding, product information, directions, etc. Furthermore, the printing 110 on each adhesive paper product 500 may take the form of embossing such that information may be placed on the adhesive paper product 500 without the use of additional chemicals or materials. It may be additionally appreciated that the adhesive paper products 500 described herein may be combined with any of the foregoing components described or previous components described herein to form a packaging assembly that is biodegradable and/or compostable in its entirety without separation of elements that may otherwise not be biodegradable and/compostable.

Figure 10:
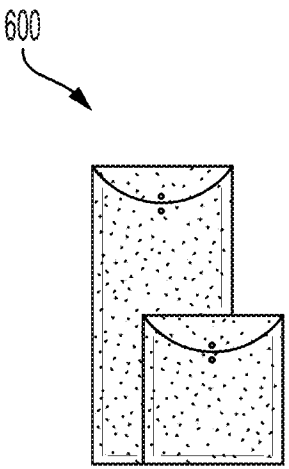
FIG. 10 is a perspective view of a product packaging accordance with the present disclosure.

Now with reference to FIG. 10, a biodegradable and/or compostable pouch 600 may be used in a product packaging assembly to hold a product or an object within the product packaging 100 or the product packaging 200. For example, the pouch 600 may be positioned within the internal cavity 108, 208 and may be shaped to receive and/or secure an item such as a piece of jewelry. In some embodiments, the pouch 600 may be constructed of a biodegradable and/or a compostable material including, but not limited to, natural materials (e.g. natural fiber materials, plant-based materials, etc.), for example but not limited to cactus leather (e.g. Desserto® cactus leather comprised of Nopal cactus), pineapple leather, mycelium, or Minim and Clarus from Natural Fiber Welding. The pouch may therefore be biodegradable, and may include a 100% recycled cotton backing, may be 100% bio-based, vegan, and phthalate free. In some embodiments, the pouch 600 may be USDA organic. Said materials used to construct the pouch 600 may be chosen based on their texture, smell, and/or aesthetic qualities such that a user's sense of touch and sight may be engaged by the pouch 600 alone or in combination with other elements of a product packaging assembly that includes the pouch 600. It is additionally envisioned that more than one pouch 600 may be positioned within the internal cavity 108, 208 at a time. It may be additionally appreciated that the pouch 600 described herein may be combined with any of the foregoing components described or previous components described herein to form a packaging assembly that is biodegradable and/or compostable in its entirety without separation of elements that may otherwise not be biodegradable and/compostable.

Now with reference to FIG. 10, a bag 700 which is configured to hold a product or an object may be used in a product packaging assembly, for example the bag 700 may receive a product that is then positioned within or alongside the product packaging 100 or the product packaging 200. The bag 700 may be made of a semi-translucent paper that permits at least partial viewing of the product within the bag 700. The bag 700 may be biodegradable, recyclable, and/or compostable, making the bag 700 more eco-friendly alternative compared to traditional plastic packaging. In particular, the bag 700 may be manufactured using a pulp other than wood pulp made from fibers other than virgin forest fibers. For example, fibers from include agricultural residues, sugarcane bagasse, husks and straw, fiber crops, and wild plants such as bamboo, hemp, jute, flax and kenaf may be used. Said materials used to construct the bag 700 may be chosen based on their texture, smell, and/or aesthetic qualities such that a user's sense of touch and sight may be engaged by the bag 700 alone or in combination with other elements of a product packaging assembly that includes the bag 700. It may be additionally appreciated that the bag 700 described herein may be combined with any of the foregoing components described or previous components described herein to form a packaging assembly that is biodegradable and/or compostable in its entirety without separation of elements that may otherwise not be biodegradable and/compostable.

Figure 12:
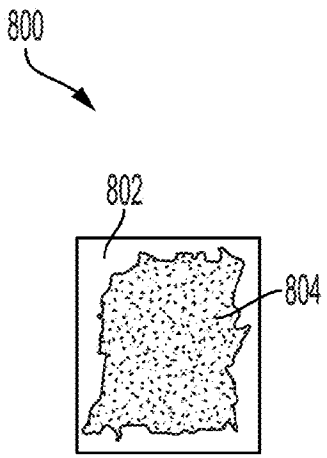
FIG. 12 is a perspective view of a filler product in accordance with the present disclosure.
Figure 11:
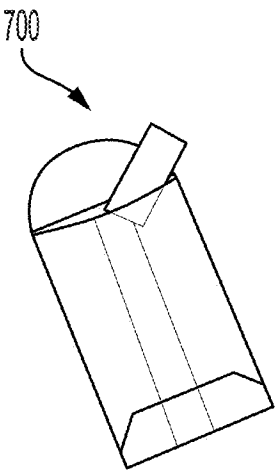
FIG. 11 is perspective of a product packaging in accordance with the present disclosure.

Often it is desirable to add materials within a product packaging to keep a product from moving around and/or to position the product in a particular visually desirable manner. Often plastics and other not easily recyclable or non-recyclable, non-compostable and/or non-biodegradable materials are used for such filler material. In reference to FIG. 12, a filler product or cushioning material 800 may be positioned within the internal cavity 108, 208 of the product packaging 100, 200 respectively to provide additional protection to any products or objects. In some embodiments, the filler product 800 may include a bag 802 filled with an organic material 804 such as soil, seeds, tea, or other easily biodegradable, recyclable, or compostable medium. For example, a tea product, such as a loose-leaf tea which may be non-GMO, USDA Organic, Kosher, Vegan, and/or Gluten Free may be used to fill the bag. The bag may be manufactured using a biodegradable and/or compostable material, or plant-based materials (e.g. without limitation bamboo, cork, hemp, jute, wood, areca palm leaf, avocado bio-plastic, bagasse, wheat straw, cactus leather, pineapple leather, mycelium, or Mirum and Clarus from Natural Fiber Welding), tea bags, reused newspapers, grapeseed, apple peel leather, reused cardboard, mushroom leather, leaf leather, grain-based leather, recycled fibers, sustainably sourced fibers, and/or other natural and/or organic materials. As mentioned previously, other organic materials such as lavender, seeds, or other suitable materials (e.g., dried flowers, other edible materials, etc.). Therefore, the filler product 800 may be biodegradable, compostable, and/or recyclable and may provide a secondary use or purpose which may be but is not limited to a consumable use or an ability to be positioned in the ground for growing of a plant. Furthermore, the sense of taste and smell may be invoked by the filler product 800, for example, the tea may be brewed such that the senses of a user may be engaged providing an additional use for the filler product besides simply protecting the product. It may be additionally appreciated that the filler product or cushioning material 800 described herein may be combined with any of the foregoing components described or previous components described herein to form a packaging assembly that is biodegradable and/or compostable in its entirety without separation of elements that may otherwise not be biodegradable and/compostable.

Figure 13:
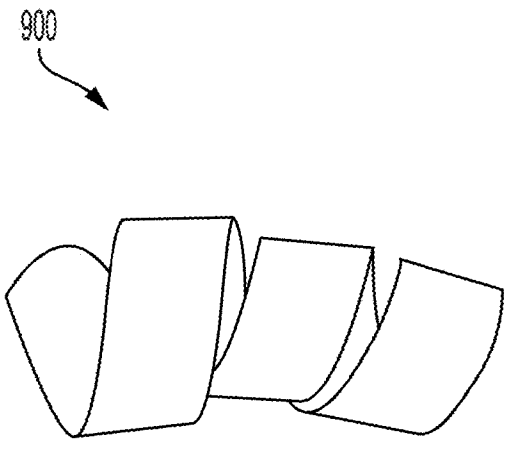
FIG. 13 is a perspective view of a ribbon in accordance with the present disclosure.

In some embodiments and as depicted in FIG. 13, a ribbon 900 or plurality of ribbons 900 manufactured from biodegradable, recyclable, and/or compostable materials may be included in the product packaging. The ribbons 900 may be used to secure other components (e.g., tags, cards, or labels) together while providing aesthetic properties. The ribbons 900 may be manufacture from natural materials, such as silk crepe. Additionally, the ribbon 900 may be dyed using natural earth pigments, natural dyes (e.g., soy-based inks), or other eco-friendly dyes that are non-damaging to the environment. It may be additionally appreciated that the ribbon 900 described herein may be combined with any of the foregoing components described or previous components described herein to form a packaging assembly that is biodegradable and/or compostable in its entirety without separation of elements that may otherwise not be biodegradable and/compostable.

Figure 14:
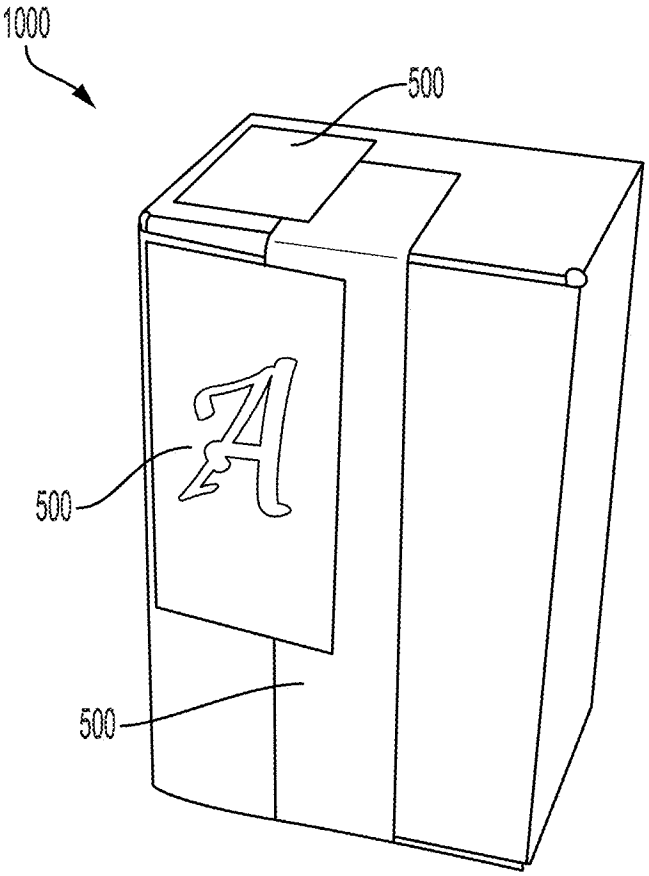
FIG. 14 is a perspective view of a shipping product packaging in accordance with the present disclosure.

In reference to FIG. 14 a non-limiting exemplary product packaging assembly may include outer packaging or shipping product packaging 1000 for shipping purposes. For example, the shipping product packaging 1000 may include an outer shipping box configured to house either the product packaging 100 or the product packaging 200 and any components that may be positioned within or alongside the product packaging 100 or the bag, including but not limited to a support material, paper products, bag, filler material, or other additional packaging elements, each of which may be biodegradable, recyclable, and/or compostable. The shipping product packaging 1000 may be configured as a box which may be secured using biodegradable, recyclable, and/or compostable adhesive tape as described above or, in the alternative or in addition too, biodegradable, recyclable, and/or compostable adhesives may be used. For example, the shipping packaging may be assembled or closed using the adhesive tape, which may include water-activated, water-based, or starch-based adhesives. The shipping product packaging 1000 may be manufactured using biodegradable, recyclable, recycled, and/or compostable materials including but not limited to recycled corrugated fiberboard, recycled paperboard, recycled paper, recycled rigid board, plant-based materials (e.g. without limitation bamboo, cork, hemp, jute, wood, areca palm leaf, avocado bio-plastic, bagasse, wheat straw, cactus leather, pineapple leather, mycelium, or Minim and Clarus from Natural Fiber Welding), tea bags, reused newspapers, grapeseed, apple peel leather, reused cardboard, mushroom leather, leaf leather, grain-based leather, recycled fibers, sustainably sourced fibers, and/or other natural materials. In some aspects, fibers for use as an alternative to wood pulp paper for providing tree-free paper include agricultural residues, sugarcane bagasse, husks and straw, fiber crops, and wild plants such as bamboo, hemp, jute, flax and kenaf.

Further, the shipping product packaging 1000 may include adhesive paper products 500 such as labels or stickers. In particular, shipping, mailing, or branding labels that are biodegradable, recyclable, and/or compostable. As described above, the adhesive paper products 500 may be constructed using biodegradable and/or compostable materials combined with eco-friendly adhesive.

Figure 15:
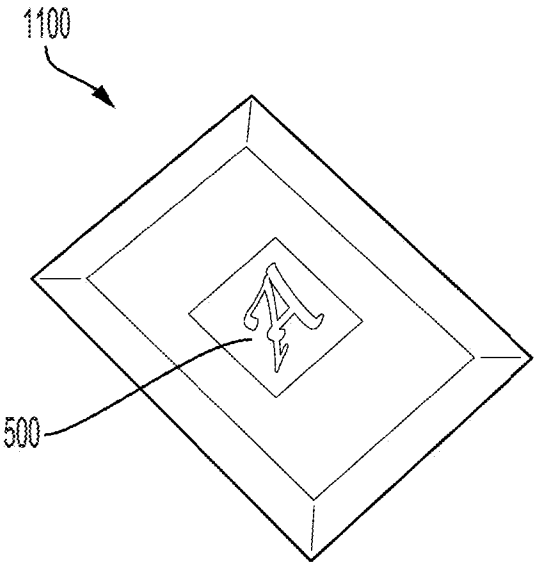
FIG. 15 is a perspective view of a shipping product packaging in accordance with the present disclosure.

Now referring to FIG. 15, a packaging assembly according to embodiments of the present disclosure may include a shipping packaging that is a compostable and/or biodegradable shipping product packaging 1100. The shipping mailer may be constructed from similar materials as described above or alternatively maybe constructed using 30% corn starch, 10-15% PLA (polyactic acid made from corn waste and other plants), 55-60% PBAT (biodegradable leaving no toxic residue). Such a combination of materials is configured such that the shipping mailer may break down in a home compost in 180 days, or in a commercial compost in 90 days.

It may be additionally appreciated that the shipping product package 1000 or the shipping product packaging 1100 described herein may be combined with any of the components described herein to form a packaging assembly that is biodegradable and/or compostable in its entirety without separation of elements that may otherwise not be biodegradable and/compostable.

Figure 16:
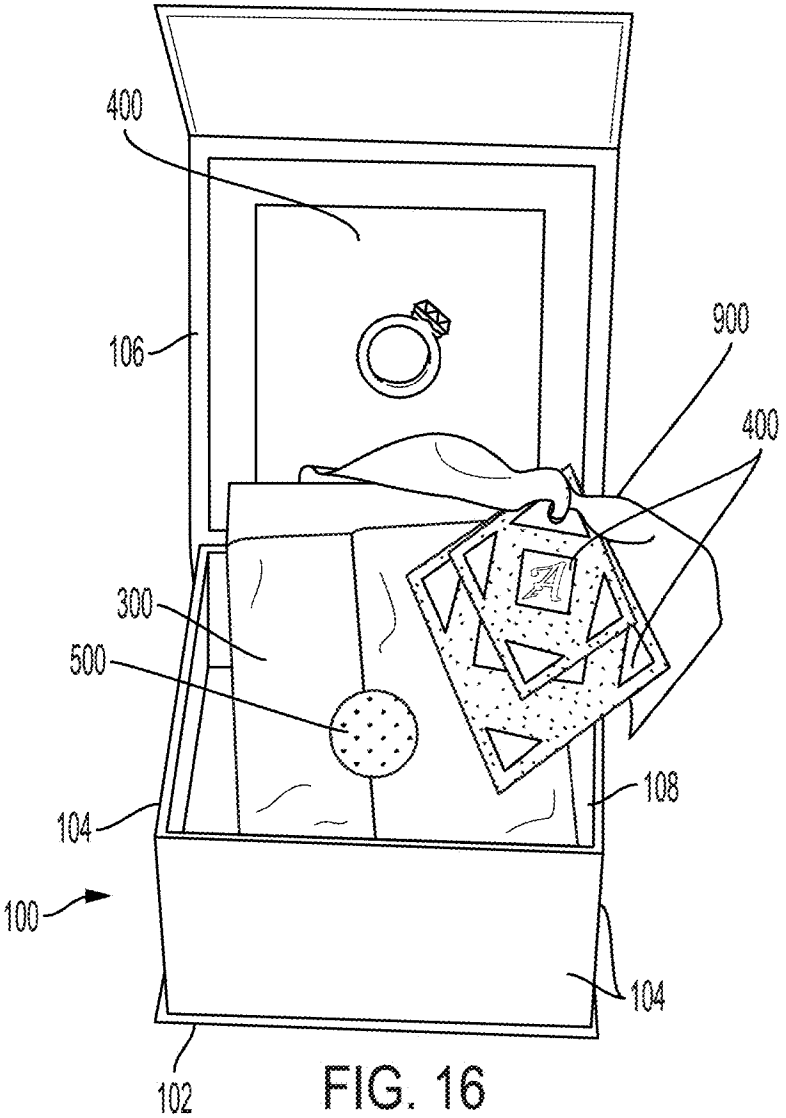
FIG. 16 is a perspective view of a product packaging assembly in accordance with the present disclosure.

Now referring to FIG. 16, a product packaging assembly 1200 according to embodiments of the present disclosure may include any combination of components described above in FIGS. 1-15 to provide a fully biodegradable and/or compostable product packaging assembly. By way of using packaging products, filler material, support material, paper products, adhesives, shipping packaging, pouches, bags, or other product packaging elements that are biodegradable and/or compostable, along with natural inks or natural earth pigment dyes for printing, as described above, a fully biodegradable and/or compostable product packaging assembly may be formed. For example, as shown, the product packaging assembly 1200 may include the biodegradable and/or compostable product packaging (e.g. product packaging 100), wherein a product may be positioned within the interior cavity 108. Said product may be wrapped in tissue paper 300, which may be secured to the product using at least one adhesive paper product 500, such as a sticker. Additionally, at least one paper product 400, such as a card or label, as described above containing product information, branding information, sales information (e.g, a receipt) or other information may be positioned within the internal cavity 108. Furthermore, the at least one paper product 400 may be constructed of seed paper, including having a biodegradable medium and a plurality of seeds embedded within the medium. Furthermore, the ribbon 900 may be used to secure the at least one paper product 400 to either the product, the product packaging 100, or any other component of the packaging assembly 1200. Each component herein may additionally include branding or other printing 110 thereon using natural inks or natural earth pigments, such that a consistent image may be presented across each component, while not utilizing ingredients that would be damaging to the environment upon biodegradation and/or composting of the product packaging assembly 1200. As mentioned previously, each component described herein may include elements that are configured to invoke or engage the senses of a user (e.g., sight, smell touch, hearing, and taste). Therefore, in some embodiments, the combination of components described herein may create a multisensory packaging assembly that, in addition to being biodegradable and/or compostable, is able to invoke all or a combination of the senses of a user, providing an additional function beyond packaging materials. For example, a user may not only receive a product in a packaging assembly according to embodiments of the present disclosure but may also engage their sense of smell (for example the tea, flowers grown from the seeds in the seed paper), sense of touch (the tissue paper, ribbon, etc.), sense of taste (the tea, edible items grown from the seed paper), and is interactive beyond just receiving the product packaging assembly by making elements plantable or ingestible to provide an additional, later found, interaction with one or more elements of the product packaging assembly.

Figure 2:
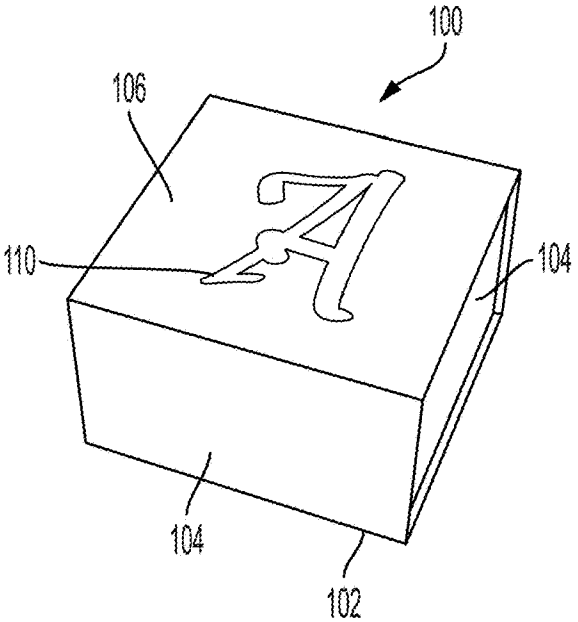
FIG. 2 is a perspective view of a second embodiment of a product packaging in accordance with the present disclosure.

Similarly, as shown in FIG. 2 the product packaging 100 may be used in a product packaging assembly according to embodiments of the present disclosure that includes a product positioned within a pouch 600, as described above, the pouch 600 being positioned within the product packaging 100 and surrounded by tissue paper 300. The tissue paper 300 may be secured to the product or the pouch 600 using at least one adhesive product 500. Furthermore, at least one paper product 400, such as a card or label, as described above containing product information, branding information, sales information (e.g., a receipt) or other information may be positioned within the internal cavity 208.

The packaging assembly 1200 described above are merely exemplary and it is envisioned that a variety of different packaging assemblies 1200 may be created or manufactured using a variety of different combinations of components described herein, the combination of which providing for a fully biodegradable, compostable, and/or recyclable product packaging assembly. Furthermore, the foregoing packaging assembly 1200 may be configured as to engage all five of the human senses, for example, the scent and taste of tea, the scent and taste of plants that may be grown from seed cards, providing a fully immersive packaging experience.

The various aspects, embodiments, implementations, or features of the described embodiments can be used separately or in any combination. In particular, it should be appreciated that the various elements of concepts from FIGS. 1-16 may be combined without departing from the spirit or scope of the invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall results as if absolute and total completion were obtained.

Preferred embodiments of this invention are described herein, including the best mode known to the inventors for carrying out the invention. The invention is susceptible to various modifications and alternative constructions, and certain shown exemplary embodiments there are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claim appended hereto as permitted by applicable law. Moreover, any combination of the above-described elements in all possible variations thereof is encompassed by the invention unless otherwise indicated herein or otherwise clearly contradicted by context. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A multi-sensory product packaging assembly comprising:

a biodegradable box including:

a bottom panel;

a plurality of side panels positioned adjacent to the bottom panel; and a top panel configured to be positioned adjacent the plurality of side panels, wherein the bottom panel, the plurality of side panels and the top panel are configured to define an interior cavity;

wherein the plurality of side panels and the bottom panel are coupled together using an adhesive, wherein the adhesive is biodegradable;

at least one piece of tissue paper positioned within the interior cavity of the biodegradable box, wherein the at least one piece of tissue paper is biodegradable; and wherein at least one paper product is positioned within the interior cavity of the biodegradable box, wherein the at least one paper product is biodegradable, and wherein the at least one paper product includes printing thereon comprising natural inks or natural earth pigment dyes.

2. The multi-sensory product packaging assembly of claim 1, wherein the biodegradable box and the at least one piece of tissue paper are each compostable.

3. The multi-sensory product packaging assembly of claim 2, wherein the biodegradable box and the at least one piece of tissue paper are each compostable via residential composting.

4. The multi-sensory product packaging assembly of claim 2, wherein the biodegradable box and the at least one piece of tissue paper are each compostable via commercial composting.

5. The multi-sensory product packaging assembly of claim 1, further comprising a biodegradable sticker secured to the at least one piece of tissue paper, the biodegradable sticker comprising a biodegradable base layer and a biodegradable adhesive.

6. The multi-sensory product packaging assembly of claim 1, wherein the at least one paper product comprises a biodegradable medium and a plurality of non-GMO seeds embedded within the biodegradable medium.

7. The multi-sensory product packaging assembly of claim 1, further comprising a pouch positioned within the interior cavity of the biodegradable box, wherein the pouch is configured to hold a product and is further configured to be biodegradable.

8. The multi-sensory product packaging assembly of claim 7, wherein the pouch comprises cactus leather.

9. The multi-sensory product packaging of claim 1 further comprising:

a biodegradable sticker secured to the at least one piece of tissue paper using a biodegradable adhesive; and a biodegradable card, wherein the biodegradable card includes a biodegradable medium and a plurality of non-GMO seeds embedded within the biodegradable medium, wherein the biodegradable box, the at least one piece of tissue paper, the at least one paper product, the biodegradable sticker, and the biodegradable card each include printed branding thereon using natural inks.

10. The multi-sensory product packaging of assembly claim 1, further comprising a shipping product packaging configured to house the biodegradable box, the at least one piece of tissue paper, and the at least one paper product, wherein the shipping product packaging is biodegradable and comprises biodegradable tape and biodegradable adhesive.

11. The multi-sensory product packaging assembly of claim 10, wherein the shipping product packaging further includes at least one label secured to an outer surface of the shipping product packaging, wherein the at least one label is biodegradable and comprises biodegradable adhesive.

12. The multi-sensory product packaging assembly of claim 1, further comprising a filler material positioned within the interior cavity of the biodegradable box, wherein the filler material is a biodegradable tea bag.

13. The multi-sensory product packaging assembly of claim 1, further comprising at least one biodegradable ribbon, wherein the at least one biodegradable ribbon is dyed using natural pigments or natural dyes.

14. A multi-sensory product packaging assembly comprising:

a biodegradable bag including a base and at least one side, wherein the base and the at least one side define an interior cavity, wherein the base and the at least one side are coupled together using a biodegradable adhesive; and at least one piece of tissue paper positioned within the interior cavity of the biodegradable bag, wherein the at least one piece of tissue paper is biodegradable, and wherein at least one paper product is positioned within the interior cavity of the biodegradable bag, wherein the at least one paper product is biodegradable, and wherein the at least one paper product includes printing thereon comprising natural inks or natural earth pigments.

15. The multi-sensory product packaging assembly of claim 14, wherein the biodegradable bag and the at least one piece of tissue paper are each compostable.

16. The multi-sensory product packaging assembly of claim 15, wherein the biodegradable bag and the at least one piece of tissue paper are each compostable via residential or commercial composting.

17. The multi-sensory product packaging assembly of claim 14, further comprising a biodegradable sticker secured to the at least one piece of tissue paper, the biodegradable sticker comprising a biodegradable base layer and a biodegradable adhesive.

18. The multi-sensory product packaging assembly of claim 14, wherein the at least one paper product comprises a biodegradable medium and a plurality of non-GMO seeds embedded within the biodegradable medium.

19. The multi-sensory product packaging assembly of claim 14, further comprising a pouch positioned within the interior cavity of the biodegradable bag, wherein the pouch is configured to hold a product and is further configured to be biodegradable.

20. The multi-sensory product packaging assembly of claim 14, further comprising:

a biodegradable sticker secured to the at least one piece of tissue paper using a biodegradable adhesive; and a biodegradable card, wherein the biodegradable card includes a biodegradable medium and a plurality of non-GMO seeds embedded within the biodegradable medium, wherein the biodegradable bag, the at least one piece of tissue paper, the at least one paper product, the biodegradable sticker, and the biodegradable card each include printed branding thereon using natural inks.

* * * * *